United States Patent [19]

Schmitt et al.

[11] Patent Number: 4,969,518

[45] Date of Patent: Nov. 13, 1990

[54] RECIPROCATING ROD TYPE DOWNHOLE PUMP

[75] Inventors: Kenneth J. Schmitt, Spring; Guy E. Wilson, Bastrop, both of Tex.

[73] Assignee: Stren Company, Houston, Tex.

[21] Appl. No.: 463,166

[22] Filed: Jan. 10, 1990

Related U.S. Application Data

[63] Continuation-in-part of Ser. No. 270,093, Nov. 14, 1988, abandoned.

[51] Int. Cl.[5] ..... E21B 43/08

[52] U.S. Cl. ..... 166/228; 166/236

[58] Field of Search ..... 166/227, 228, 229, 235, 166/236; 210/94, 450, 493.2, 452

[56] References Cited

U.S. PATENT DOCUMENTS

| | | | |
|---|---|---|---|
| 1,343,157 | 6/1920 | Putnam | 166/105.3 |
| 2,175,540 | 10/1939 | O'Neill | 166/227 |
| 2,539,767 | 1/1951 | Anderson | 210/348 |
| 2,981,332 | 4/1961 | Miller et al. | 166/228 |
| 3,255,821 | 6/1966 | Curlet | 166/228 |
| 3,280,911 | 10/1966 | Strange et al. | 166/228 |
| 3,379,252 | 4/1968 | Heckler et al. | 166/228 |
| 3,768,557 | 10/1973 | Spurlock et al. | 166/288 |
| 4,014,387 | 3/1977 | Fink | 166/314 |
| 4,241,787 | 12/1980 | Price | 166/105 |
| 4,526,230 | 7/1985 | Kojicic | 166/236 |
| 4,624,319 | 11/1986 | Van Der Borght | 166/369 |
| 4,731,184 | 3/1988 | Ostreicher et al. | 210/450 |
| 4,811,790 | 3/1989 | Jennings, Jr. et al. | 166/228 |

*Primary Examiner*—Ramon S. Britts
*Assistant Examiner*—Terry Lee Melius
*Attorney, Agent, or Firm*—Vaden, Eickenroht, Thompson & Boulware

[57] ABSTRACT

There is disclosed a reciprocating rod type downhole pump for an oil well wherein a filter on the lower end of the barrel of the pump includes a solid body of filtering media having small tortuous passageways connecting its inner and outer sides and decreasing in size from its outer to its inner side.

13 Claims, 3 Drawing Sheets

RECIPROCATING ROD TYPE DOWNHOLE PUMP

This application is a continuation-in-part of our prior application, Ser. No. 07/270,093, filed November 14, 1988, and entitled "Recipricating Rod Type Downhole Pump" now abandoned.

This invention relates generally to a reciprocating rod type downhole pump for an oil well; and, more particularly, to such a pump of the type which is retrievable from within a well tubing and which has an improved filter at its lower end for preventing extraneous material in the well fluid from entering the pump.

As well known in the art, if sand and other mineral solids, as well as organic solids and combinations of them, which are commonly present in the well fluid, are allowed to enter the pump, they may severly damage its working parts, and particularly the plunger and other moving parts, to the extent that the pump will not function properly. Also, the gas in the well fluid may lessen its density and thus, upon entry into the pump, reduce the efficiency of the pump by causing gas locks and/or pounding of the pump.

In an effort to exclude these particles from the pump, it is common to mount a filter on the lower end of the barrel. Conventionally, these filters have comprised screens of various types, one of which has slots formed therein between "vee" bars wrapped about a cylindrical screen suspended from the open lower end of the barrel. The slots are normally about 0.010 to 0.005 inches and thus are intended to exclude particles larger than that and even smaller particles which may bridge over the slots.

Filters of this type are not only incapable of excluding gas entrained in the well fluid, but also, due to their construction, impractical to use with smaller slots and thus are incapable of excluding smaller particles. Also, surges of well fluid during the pumping cycle tend to breakdown the bridges of smaller particles, and the resulting surges of high concentrations of particles are generally more damaging to the pump than would be a steady flow. Still further, filters of this type are unable to exclude gelatinous organic material which may be extruded through the slots and thus permitted to foul the pump by adhering to its parts.

An object of this invention is to provide a pump having a filter which overcomes one or more of these and other problems encountered with prior filters used for this purpose.

A more particular object is to provide such a filter which is capable of excluding smaller solid particles, as well as excluding gas entrained in the well fluid, but which is nevertheless relatively inexpensive to manufacture.

These and other objects are accomplished, in accordance with the illustrated embodiments of the invention, by a filter which includes an annular body of solid filtering media having small passages connecting its inner and outer sides and carried within a housing suspended from the open lower end of the pump barrel so as to require well fluid in the well bore to flow through the passages in order to enter the pump barrel. More particularly, the media body is carried within an outer perforated wall of the housing so as to protect it from damage as it is raised and lowered with the pump within the well tubing, and the passages form tortuous paths which decrease in size from the outer to the inner sides of the body.

The passages in the media body, which may be a casting of acrylic fibers and phenolic resins, preferably have a nominal size of about 0.0004 inches so as to exclude virtually all solid particles of larger size and capture or retain a large percentage of particles as small as 0.0004 inches within the passages. The tortuous paths of the decreasing sizes of passages also trap the gelatinous organic particles and cause gas to be knocked out of or separated from the well fluid before entering the pump. When the passages of the media body become clogged, the filter may be retrieved along with the pump to permit its replacement.

In the illustrated embodiments of the filter, the housing also includes an inner perforated wall which is spaced from the outer wall to form an annulus in which the media body is carried. Both the inner and outer walls are relatively thin and have relatively large, closely spaced perforations so as to be capable of collapsing due to high compressive loads and thus serve as a shock absorber for the pump. One or both of the walls is fixed to the upper and lower ends of the housing to provide tensile strength to the housing in the event the pump becomes stuck in the tubing.

Considerable cost would be incurred in pulling a pump during a pump cycle for the sole purpose of replacing the filtering media. In fact, this cost far outweighs the financial risk of damaging the pump with extraneous material from the well fluid, at least during the limited time of an ordinary pump cycle. Hence, it is a further object of this invention to provide a filter of the type above described which is of such construction as to permit well fluid to continue to be pumped even when the filtering media becomes clogged.

It may also be found that temperature fluctuations in the well bore cause the body of filtering media to expand and contract, and it is still another object of the invention is to provide a filter of the type described in which well fluids are confined for passage through the body despite such fluctuations.

Yet a further object is to provide a filter of the type above described which is of such construction as to permit the media body to be easily and quickly replaced without having to disassemble the entire housing.

Still a further object is to provide a filter of the type above described which accomplishes each and every one of the foregoing objects.

These additional objects are accomplished, in accordance with a preferred embodiment of the invention by a filter of the type above described wherein a means is provided for opening the normally closed lower end of the housing when the media body becomes sufficiently clogged as to cause a predetermined pressure differential across it. As illustrated, the lower end of the housing comprises a head having a passageway therethrough, a closure member seatable on the inner end of the passageway, a spring urging the closure member against the seat, and means for adjusting the force of the spring and thus the predetermined pressure differential at which the lower end of the housing is opened.

In accordance with another novel aspect of the invention, a resilient means is arranged within the annulus between the inner and outer walls of the housing to act between one end of the housing and one end of the media body in order to urge the other end of the media body against the other end of the housing despite axial expansion and contraction of the media body. More particularly, a means is provided for seating between the media body and the inner wall at one end of its perforations so as to continue to require well fluid to pass through the media body despite its axial expansion and contraction.

In accordance with a still further novel aspect of the invention, the ends of the outer perforated wall of the housing are removably received about the heads on the upper and lower ends of the housing, and the ends of the inner wall are threadedly connected to the heads so as to hold the housing in assembly position. Thus, it is merely necessary to threadedly disengage one head from the adjacent end of the inner wall to permit access to the annulus for the purpose of replacing the media body.

In the drawings, wherein like reference characters are used throughout to indicate like parts:

Figure 1:
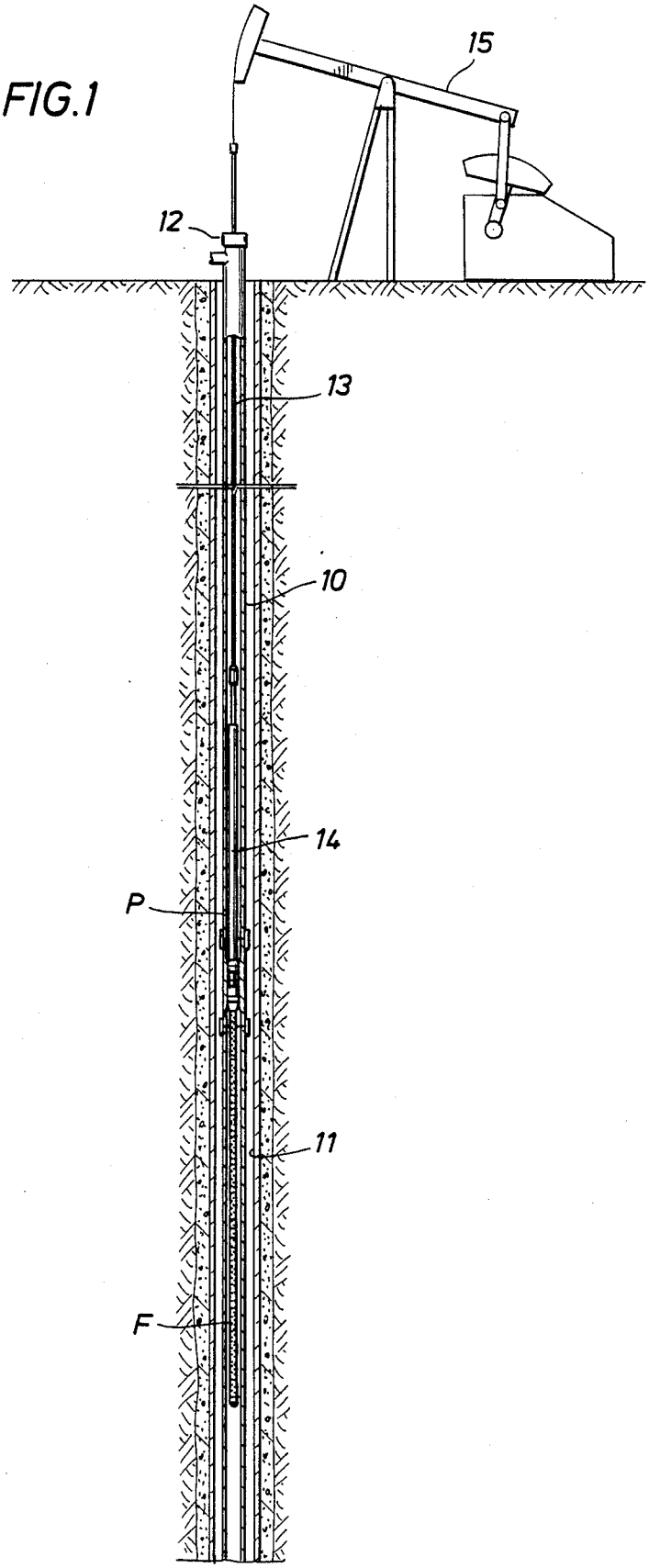
FIG. 1 is a vertical sectional view of a pump including a filter constructed in accordance with the present invention installed within the well tubing of a well bore.
Figure 2:
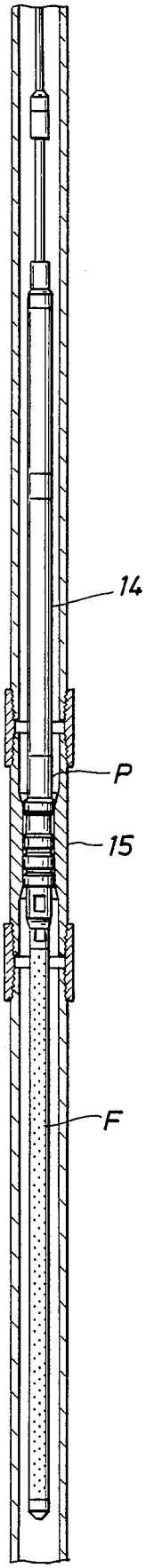
FIG. 2 is an enlarged sectional view of a portion of the tubing including a seal bore nipple in which the barrel of the pump is sealably disposed.

With reference now to the details of the above described drawings, and particularly FIG. 1, a tubing 10 is suspended within a casing 11 which lines the well bore, and a polish rod 13 extends downwardly through a head 12 on the upper end of the tubing to connect with a sucker rod leading to the plunger of the pump P within the barrel 14 thereof. As shown in FIG. 1, the upper end of the sucker rod is connected to a pumping jack 15 which reciprocates the sucker rod and thus the plunger within the pump barrel. As shown in FIG. 2, the lower end of the barrel is sealably mounted within a seal bore nipple 15 of the tubing so that well fluid entering the tubing must pass through the pump in order to be produced through the head 12.

Figure 3:
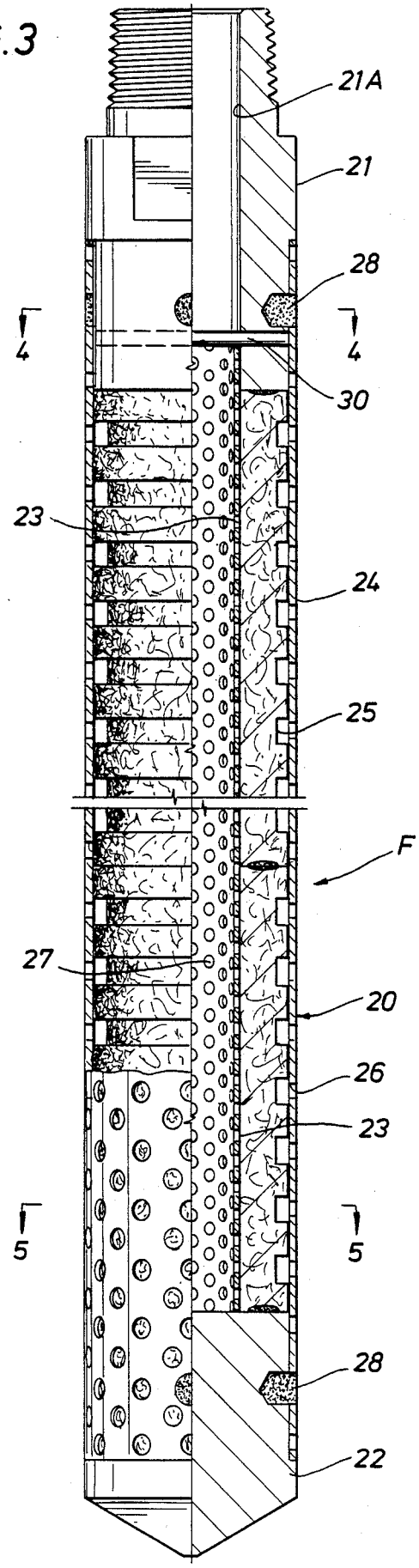
FIG. 3 is an enlarged, partial sectional view of one embodiment of the filter with the right side of the media body shown in section and the left side thereof shown partly in elevation.

As previously described, a filter F is suspended from the lower end of the barrel 14 so that, with the barrel located in the seal bore nipple, it will exclude solid particles from the pump as previously described. As shown in FIG. 3, one embodiment of the filter includes a housing 20 having a head 21 at its upper end and a head 22 at its lower end. The upper head 21 is threaded for connection to the pump barrel 14 and has a bore 21A therethrough opening to the pump barrel. The housing also includes inner and outer walls 23 and 24 which extend between the upper and lower heads to form an annulus in which an annular body 25 of filtering media is disposed. As shown, relatively large perforations 26 are formed within the outer wall, and somewhat smaller perforations 27 are formed in the inner wall.

The upper and lower ends of the outer wall 24 are received about reduced diameter portions on the upper and lower heads of the housing, and are fixed to the upper and lower heads by weldments 28, whereby the housing has substantial tensile strength. The lower end of the inner wall extends to the upper side of the lower head 22 of the housing, and the upper end thereof is received within the bore 21A through the open upper head of the housing. A pin 30 extends through the upper head 21 and across its bore 21A to limit upward movement of the inner wall.

The upper and lower ends of the media body extend between and are sealed with respect to the upper and lower heads of the housing so as to confine the flow of well fluid through passages connecting the inner and outer sides of the media body. As shown, the media body is made up of multiple sections whose opposite ends are sealed with respect to one another. Thus, it is contemplated that the filter may be of considerable length relative to its diameter as shown in FIGS. 1 and 2.

As previously described, the media body has small passages, preferably of a nominal size of about 0.0004 inches, which connect its inner and outer sides and thus form the only means by which well fluid may enter the pump. As also previously described, these passages are of decreasing size from the outer to the inner sides of the body as so to retain and capture a large percentage of solid particles smaller than that size. More particularly, the passages form tortuous paths which are instrumental in capturing gelatinous material and causing gas particles in the well fluid to be separated therefrom before entering the pump.

As also previously described, the media body is preferably a casting of acrylic fibers impregnated with phenolic resin, with the passages formed randomly therein during casting. A media body suitable for this purpose is manufactured and sold by Cuno, Inc. of Meriden, Connecticut, and identified by the registered trademark "Micro-Klean". As shown, the media body has grooves 29 formed therein to increase the number of randomly formed passages for receiving well fluid on the outer side of the body.

The perforations in the outer wall are about 0.125 inches in diameter, with those in the inner wall being substantially smaller. The perforations in both walls are relatively close together, and the walls are collapsible to act as a shock absorber in the event the pump becomes stuck.

Figure 4:
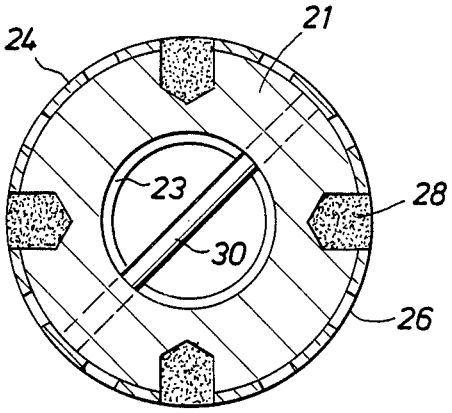
FIG. 4 is a cross-sectional view of the filter of FIG. 3, as seen along broken lines 4—4 of FIG. 3.
Figure 5:
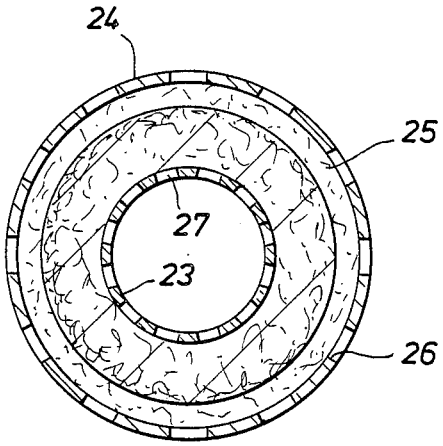
FIG. 5 is another cross-sectional view of the filter of FIG. 3, as seen along lines 5—5 of FIG. 3, and FIGS. 6A and 6B are cross-sectional views of the upper end lower ends of a preferred embodiment of the filter, wherein, as in FIG. 3, the right side of the media body is shown in section and the left side thereof is shown partly in elevation.
Figure 6A:
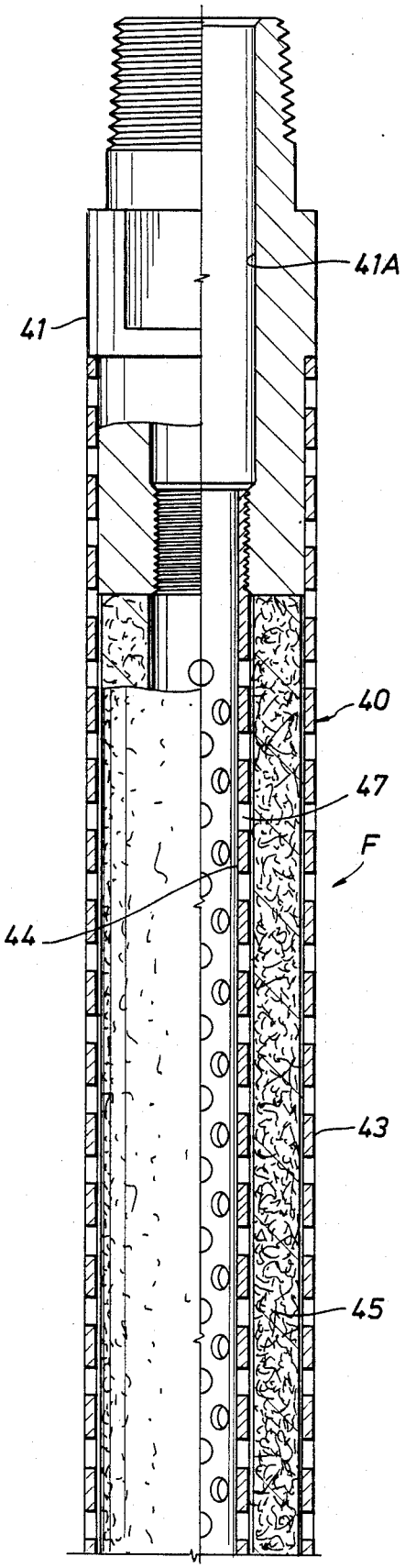
Figure 6B:
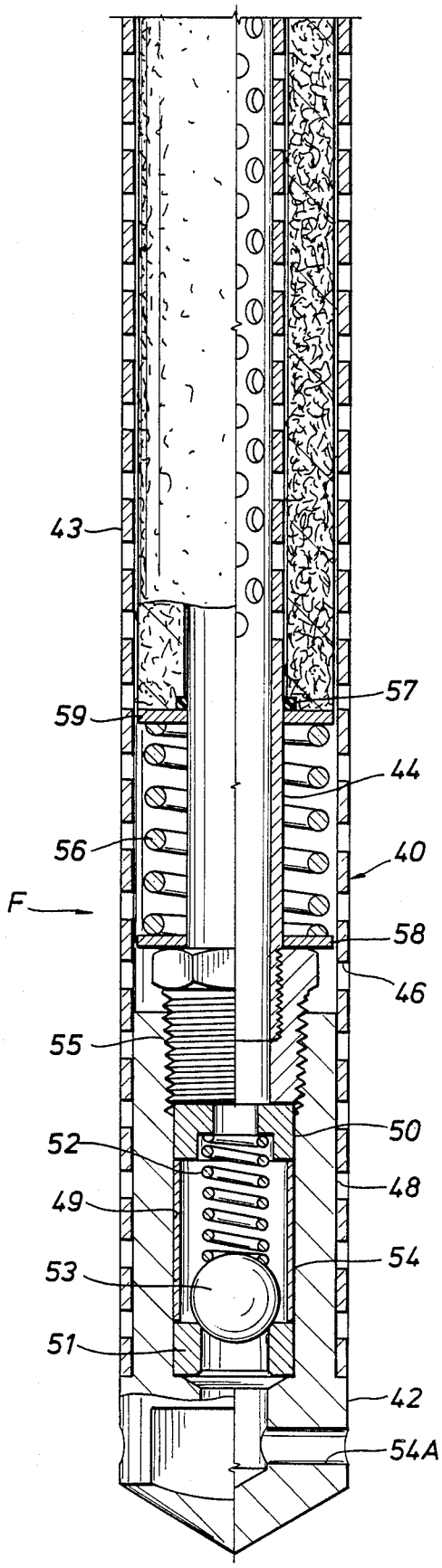

The preferred embodiment of the filter shown in FIGS. 6A and 6B is similar to that of the filter described in connection with FIGS. 3 to 5 in that it includes a housing 40 having a head 41 at its upper end and a head 42 at its lower end. More particularly, the housing includes an outer wall 43 and an inner wall 44 extending between the heads and spaced from one another to form an annulus in which a body 45 of filtering media is disposed. As shown, the outer wall has perforations 47 and the inner wall has perforations 48, thus providing an axially compressible housing, as in the case of the previously described filter.

The upper and lower ends of the outer wall are removably disposed over recessed portions of the outer sides of the upper and lower heads, and the inner wall 44 is threadedly connected at its opposite ends to the upper and lower heads so as to secure them in spaced apart relation, thus providing the housing with high tensile strength. As shown, the upper end of the inner wall connects with a bore 41A extending through the upper head so as to form a continuation of the pump barrel when threadedly connected to the lower end of the pump barrel.

The body of filtering media may be of a construction identical to that described in connection with the prior embodiment of the filter. More particularly, and as will be described to follow, it is so mounted within the annulus between the inner and outer walls of the housing as to require well fluid to pass therethrough prior to entering the pump barrel, at least under normal operating conditions when the media body is not overly clogged.

The lower head includes a body 48 having a passageway 49 therethrough connecting at its upper end with the interior of the housing and at its lower end with the exterior of the housing. Flow through the passageway is controlled by means of a ball 53 adapted to seat on the upper end of the inner diameter of a ring 51 mounted on a shoulder in the reduced diameter lower end of the passageway 49. The lower reduced end of the passageway in turn connects with a side port 54A leading to the exterior of the housing.

The ball is yieldably urged to seated position by means of a coil spring 52 which is compressed between the upper side of the ball and a collar 50 supported on the upper end of a spacer sleeve 54 which in turn is mounted within the passageway on the upper end of the ring 51. The collar is held downwardly on the upper end of the sleeve by means of a hollow nut 55 threaded to the upper end of the passageway 49, whereby, upon removal of the nut and collar, sleeve 54 may be replaced with other sleeves of difference lengths so as to permit adjustment of the force of the spring 51 and thus the differential pressure between the inside and outside of the housing at which the ball 53 will open. Thus, as previously described, the ball is adapted to be raised from its seat, against the force of the spring 51, so as to permit well fluid to bypass the filter when the filter becomes clogged to a predetermined extent.

The lower end of the inner sleeve is threadedly connected to the bore of the hollow nut 55, and another coil spring 56 is disposed within the annulus between the upper end of the nut 55 and the lower end of the media body 45. The lower end of the spring 56 bears on a washer 58 surrounding the inner wall and mounted on the upper end of the nut 55, and the upper end thereof engagesan upper washer 59 carried about the lower end of the media body above the upper end of the coil spring 56. As previously described, the spring is compressed between the washers so as to maintain the media body sections in end-to-end engagement despite expansion and contraction of the media body during temperature fluctuations in the well, and an O-ring 57 is carried within the inner lower corner of the lower end of the media body so as to seal with respect to the inner wall of the housing beneath the perforations 47 in the inner wall, thereby confining well fluid for flow through the filter during the time the lower head is normally closed. Thus, the O-ring 57 will form a sliding seal between the lower end of the filter media body and the inner wall during such expansion and contraction. The upper end of the media body may be sealed with respect to the upper head, and the opposing ends of the media body sections may be sealed with respect to one another, so as to require well fluid to pass through the media body during normal operations of the filter.

As will be appreciated from the foregoing description, the parts of the filter of FIGS. 6A and 6B may be readily assembled or disassembled upon makeup or breakout of its various parts from its lower end to its upper end. In this respect, the final assembly of the filter involves the threaded connection with the upper head 41 to the upper end of the inner wall 44. Thus, as previously noted, that the upper head 41 may be easily and quickly removed to permit replacement of the media body 45 without disassembly of the entire filter.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. In a downhole pump for an oil well which has a pump barrel removably insertable within the well tubing and a plunger suspended by a rod for reciprocation within the barrel, the improvement comprising a filter including a housing suspended from an open lower end of the barrel and having an outer perforated wall, and an annular body of solid filtering media having small passages connecting its inner and outer sides and carried within the housing on the inner side of the outer wall so as to require well fluid in the well bore to flow through the passages in order to enter the pump barrel, said passages forming tortuous paths which decrease in size from the outer to the inner sides of the body.

2. In a pump of the character defined in claim 1, wherein the housing also has an inner perforated wall to form an annulus in which the media body is contained.

3. A filter for a reciprocating rod type downhole pump which has a pump barrel removably disposable within the tubing of an oil well and a plunger suspended by a rod for reciprocation within the barrel, comprising a housing having an open upper end connectible to an open lower end of the pump barrel, a lower end, an outer perforated wall extending between the upper and lower ends, an inner perforated wall extending between the upper and lower ends and spaced from the outer wall to form an annulus between them, and an annular body of solid filtering media having small passages connecting its inner and outer sides and carried within the annulus intermediate its upper and lower ends so as to require well fluid in the well bore to flow through the passages in order to enter the pump barrel, said passages forming tortuous paths which decrease in size from the outer to the inner sides of the body.

4. A filter of the character defined in claim 3, wherein the media body is a casting of acrylic fibers impregnated with phenolic resin.

5. A filter of the character defined in claim 3, wherein the nominal size of the passages in the media body is about 0.0004 inches.

6. A filter for a reciprocating rod type downhole pump which has a pump barrel disposable within the tubing of an oil well and a plunger suspended by a rod for reciprocation within the barrel, comprising a housing having an open upper end connectible to an open lower end of the pump barrel, a normally closed lower end, an outer perforated wall extending between the upper and lower ends, an annular body of solid filtering media carried within the housing on the inner side of the outer wall so that well fluid in the well bore must flow through the media body in order to enter the pump barrel, and means for opening the lower end of the housing when the media body becomes sufficiently clogged as to cause a predetermined pressure differential thereacross.

7. A filter of the character defined in claim 6, wherein the lower end of the housing comprises a head having a passageway therethrough, a closure member seatable on the inner end of the passageway, a spring urging the closure member against the seat, and means for adjusting the force of the spring and thus the predetermined pressure differential at which the lower end of the housing is opened.

8. A filter for a reciprocating rod type downhole pump which has a pump barrel disposable within the tubing of an oil well and a plunger suspended by a rod for reciprocation within the barrel, comprising a housing having an upper head connectible to an open lower end of the pump barrel and having a bore therethrough for connecting with the interior of the barrel, when so connected, a normally closed lower head, an outer perforated wall extending between the upper and lower heads, and an inner perforated wall extending between the heads and spaced inwardly of the outer wall to form an annulus between the inner and outer walls, an annular body of solid filtering media carried within the annulus, resilient means arranged within the annulus and acting between one of said heads and one of the media body in order to urge the other end thereof against the other head despite axial expansion and contraction of the media body, and means sealing between the media body and the inner wall to require well fluid in the well bore to pass through the media body in order to enter the pump barrel.

9. A filter of the character defined in claim 8, wherein the body of filtering media includes sections stacked in end-to-end relation.

10. A filter for a reciprocating rod type downhole pump which has a pump barrel disposable within the tubing of an oil well and a plunger suspended by a rod for reciprocation within the barrel, comprising a housing having an upper head connectible to an open lower end of the pump barrel and having a bore therethrough for connecting with the interior of the barrel, when so connected, a normally closed lower head, an outer perforated wall extending between and having its ends removably received about the upper and lower heads, an inner perforated wall having its upper end threadedly connected to the upper head and its lower end threadedly connected to the lower head to form an annulus between the heads, and an annular body of solid filtering media carried within the annulus, said media having small passages connecting its inner and outer sides so as to require well fluid in the well bore to flow through the passages in order to enter the pump barrel, said passages forming tortuous paths which decrease in size from the outer to the inner side of the body, one of the heads being threadedly disengagable from the inner wall to permit removal and replacement of the media body.

11. A filter of the character defined in claim 10, including means for opening the normally closed lower end of the housing when the media body becomes sufficiently clogged to cause a predetermined pressure differential thereacross.

12. A filter of the character defined in claim 10, including resilient arranged within the annulus and acting between one of said heads and one end of the media body in order to urge the other end thereof against the other head despite axial expansion and contraction of the media body, and means sealing between the media body and the inner wall to require well fluid in the well bore to pass through the media body in order to enter the pump barrel.

13. A filter of the character defined in claim 11 including, resilient means arranged within the annulus and acting between one of said heads and one end of the media body in order to urge the other end thereof against the other head despite axial expansion and contraction of the media body, and means sealing between the media body and the inner wall to require well fluid in the well bore to pass through the media body in order to enter the pump barrel.

* * * * *